US009700111B2

(12) United States Patent
Gregory

(10) Patent No.: US 9,700,111 B2
(45) Date of Patent: Jul. 11, 2017

(54) EXTENDABLE SLED DEVICE AND METHOD FOR ITS USE

(71) Applicant: Matthew Gregory, Yeadon, PA (US)

(72) Inventor: Matthew Gregory, Yeadon, PA (US)

( * ) Notice: Subject to any disclaimer, the term of this patent is extended or adjusted under 35 U.S.C. 154(b) by 0 days.

(21) Appl. No.: 14/551,621

(22) Filed: Nov. 24, 2014

(65) Prior Publication Data

US 2015/0145223 A1 May 28, 2015

Related U.S. Application Data

(60) Provisional application No. 61/908,045, filed on Nov. 23, 2013.

(51) Int. Cl.
*A45C 15/00* (2006.01)
*A45C 5/14* (2006.01)

(52) U.S. Cl.
CPC ..... *A45C 5/146* (2013.01); *A45C 2005/147* (2013.01)

(58) Field of Classification Search
None
See application file for complete search history.

(56) References Cited

U.S. PATENT DOCUMENTS 4,618,035 A * 10/1986 Mao ..... A45C 3/004 16/113.1
5,515,954 A 5/1996 Nordstrom
5,568,848 A * 10/1996 Liang ..... A45C 13/262 190/115
5,779,251 A * 7/1998 Meier ..... B62B 1/002 188/22
5,813,503 A * 9/1998 Chang ..... A45C 5/146 190/115
5,873,439 A * 2/1999 Liang ..... A45C 5/14 16/34
5,984,326 A * 11/1999 Abraham ..... A45C 5/14 190/18 A
6,039,149 A * 3/2000 Bedja ..... B62B 1/12 182/165
6,082,510 A * 7/2000 Liang ..... A45C 5/14 16/34
6,182,981 B1 * 2/2001 Kuo ..... A45C 5/14 190/18 A
6,802,409 B1 10/2004 Tiramani
6,938,740 B2 9/2005 Gandy
(Continued)

FOREIGN PATENT DOCUMENTS

GB 2492089 12/2012

*Primary Examiner* — John Walters
*Assistant Examiner* — Hilary L Johns
(74) *Attorney, Agent, or Firm* — Muskin & Farmer, LLC

(57) ABSTRACT

An extendable sled device for transporting luggage or other bulky objects up sets of stairs with less effort. The extendable sled device is integrated with, or attached to, the object being transported. The extendable sled device has an extendable sled controlled by an extension mechanism. The extendable sled is lowered by the extension mechanism when in use, and retracted when not in use. The extendable sled can also have one or more stopper mechanisms, which are used to arrest the luggage on a set of stairs if a user accidently releases the luggage midway up the flight. The stopper mechanisms prevent the luggage from falling back down the steps and potentially injuring people.

14 Claims, 12 Drawing Sheets

(56) References Cited

U.S. PATENT DOCUMENTS

| | | | | |
|---|---|---|---|---|
| 7,837,206 | B1 * | 11/2010 | Lee | A45C 5/14 280/30 |
| 7,934,729 | B2 * | 5/2011 | Murphy | A63B 55/00 280/47.17 |
| 8,020,678 | B2 * | 9/2011 | Tsai | A45C 5/146 190/115 |
| 8,146,722 | B1 | 4/2012 | Moreno | |
| 8,282,109 | B1 * | 10/2012 | Arjomand | A45F 4/02 280/30 |
| 2004/0200667 | A1 * | 10/2004 | Babkes | B62B 1/002 182/20 |
| 2006/0213735 | A1 | 9/2006 | Weinstein | |
| 2007/0215424 | A1 | 9/2007 | Mittleman | |
| 2008/0230339 | A1 * | 9/2008 | Pereira | A45C 5/03 190/18 A |
| 2009/0166140 | A1 | 7/2009 | Gorga | |
| 2010/0117312 | A1 * | 5/2010 | Walkingshaw | A61G 5/066 280/5.22 |
| 2010/0126815 | A1 | 5/2010 | Tauro | |

* cited by examiner

FIG. 11
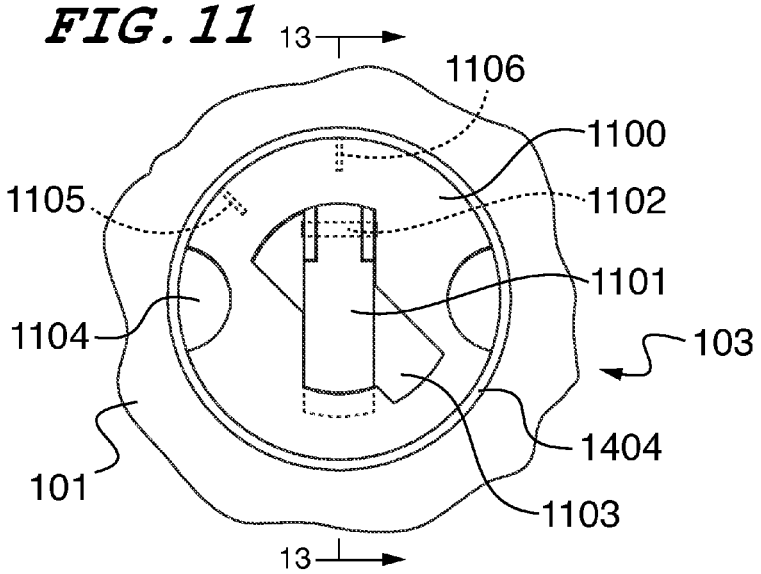
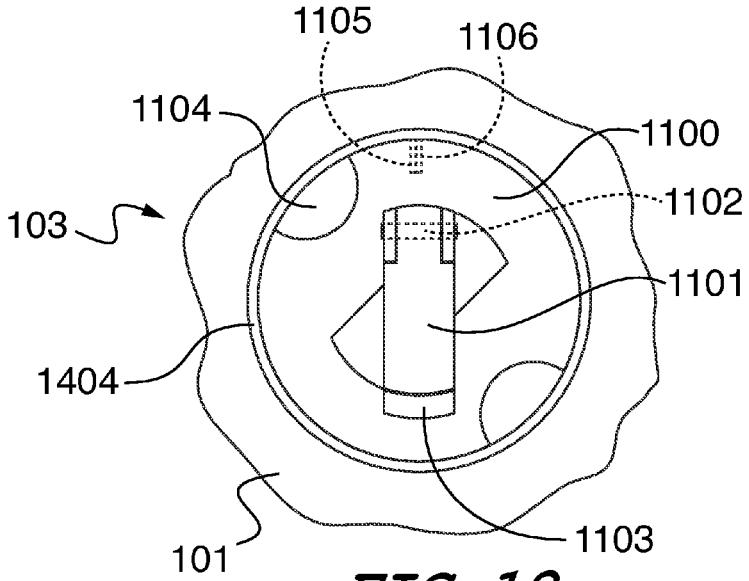
FIG. 12

FIG. 15
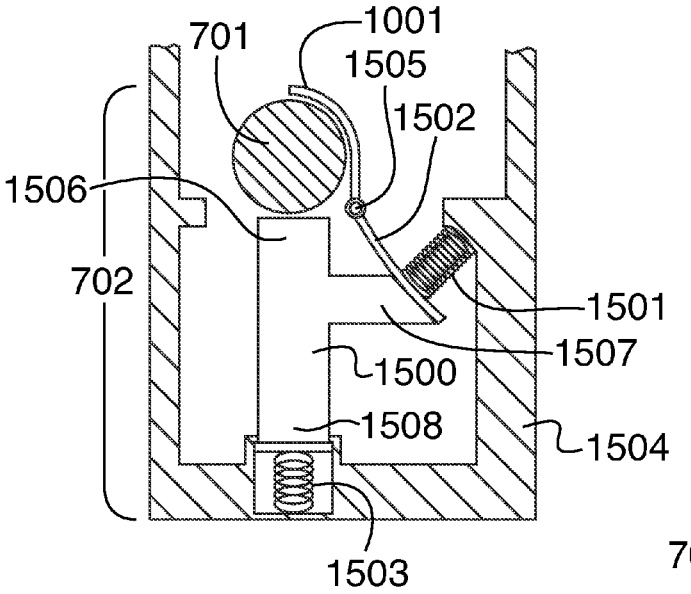
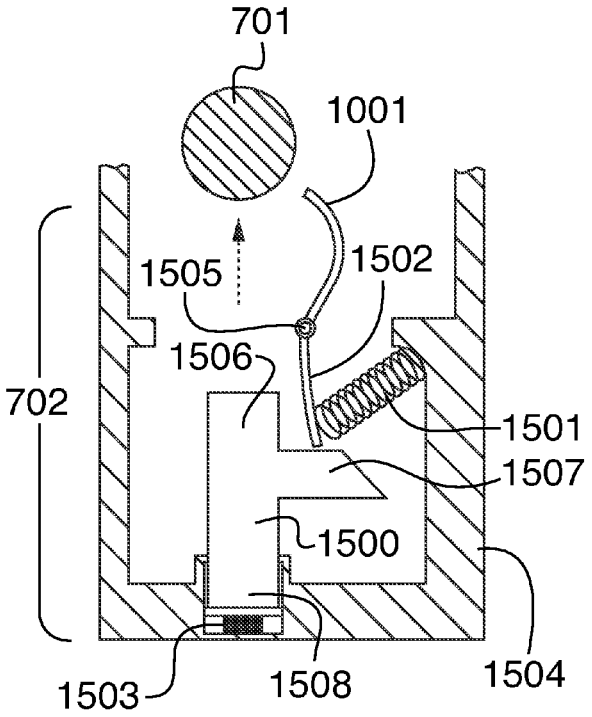
FIG. 16

EXTENDABLE SLED DEVICE AND METHOD FOR ITS USE

CROSS REFERENCE TO RELATED APPLICATIONS

This application claims benefit to provisional patent application No. 61/908,045 filed Nov. 23, 2013, which is incorporated by reference herein in its entirety.

FIELD OF THE INVENTION

The present device relates to facilitate the transporting of luggage up or down a staircase through the use of an extendable sled-like device.

BACKGROUND

Traditionally, suitcases and other luggage carriers are designed with wheels at the bottom to permit the luggage to be easily rolled across flat surfaces. Without wheels, an individual would have to carry the luggage which could be tiresome and unwieldy, and could cause unwanted delay while traveling. Instead, wheels allow an individual to easily transport the luggage by smoothly pulling the luggage while walking. However, while traditional wheeled luggage facilitates luggage transport over a flat or planar surface, the design poses a problem when an individual is traveling over vertical surfaces such as stairs or curbs. An individual, in transporting traditional luggage over stairs, must exert energy to pull the piece of luggage vertically up to clear each step or curb. This method can be tiresome when an individual must walk up a flight of stairs or a high curb. Alternatively, an individual can drag the luggage along with him or her while walking up stairs. However, this method allows the piece of luggage to slam into each step, which could result in damage to the stairs, the luggage, or articles carried within the luggage. Also, the impact of the luggage with the stairs is often absorbed through the handle creating odd forces against the hand, which could result in injury to the user.

Some locations such as airports and train or bus stations have escalators, elevators, or ramps that allow travelers to roll their wheeled luggage to a higher location without the need to lift the luggage over stairs or curbs. However, not every staircase or curb has an escalator or ramp close by to facilitate luggage transport, and some public places and residential areas lack any means to facilitate the transport of wheeled luggage over stairs. Additionally, the use of elevator and other means to travel between floors of a building is often inconvenient and can be time consuming to find. What is needed is a device that is a part of, or can be added to, wheeled luggage to facilitate the transport of the wheeled luggage up or down vertical obstacles such as stairs or curbs. Specifically, the extendable sled device can be connected to wheeled luggage and can be easily deployed when a user encounters a vertical obstacle, such as stairs and can be stowed against, or within, the luggage when it is not needed.

SUMMARY OF THE INVENTION

It is an aspect of the present invention to provide an extendable sled device that can be connected or integrated to wheeled luggage, can be easily deployed when a user encounters a vertical obstacle, and can be stowed within or against the luggage when not needed.

The above aspects can also be obtained by a method using the extendable sled device above. These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present device, as well as the structure and operation of various embodiments of the present device, will become apparent and more readily appreciated from the following description of the preferred embodiments, taken in conjunction with the accompanying drawings of which:

FIG. 11 is a perspective, partially transparent view of a stopper mechanism in a locked position, according to an embodiment.

FIG. 12 is a perspective, partially transparent view of a stopper mechanism in an unlocked position, according to an embodiment.

FIG. 15 is a cut-away view of a locked locking mechanism for an integrated extendable sled device, according to an embodiment.

FIG. 16 is a cut-away view of an unlocked locking mechanism for an integrated extendable sled device, according to an embodiment.

DETAILED DESCRIPTION

Figure 1:
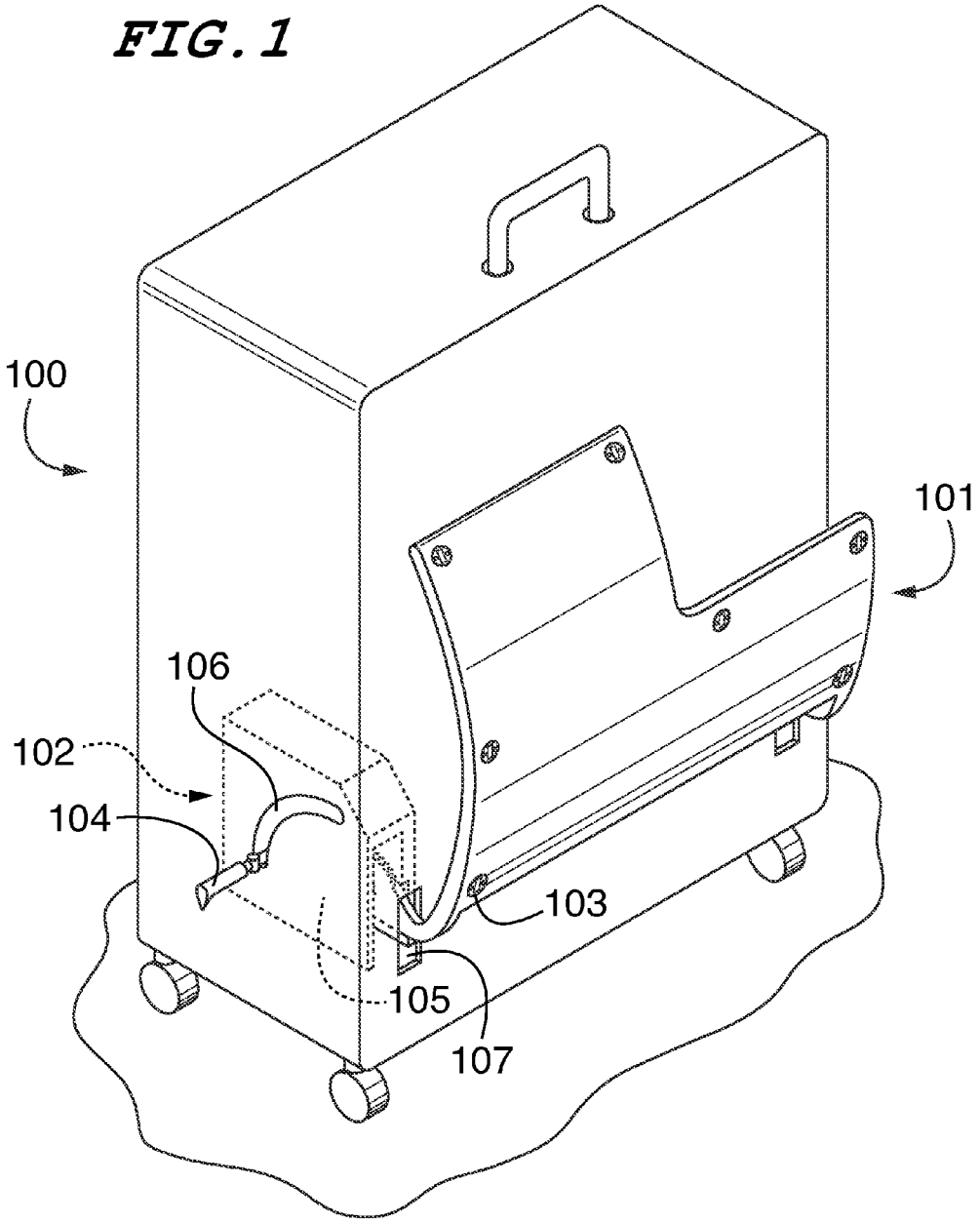
FIG. 1 is a perspective view of luggage with an integrated extendable sled device, shown in a stored position, according to an embodiment.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

The present extendable sled device can be designed to be integrated with a piece of luggage to facilitate the transport of the luggage up and down flights of stairs. The extendable sled device can also be attached to a standard piece of luggage. The sled can be S-curved, C-curved, straight, J-curved, or have any other shape suitable for this purpose.

The sled device can be connected to the luggage or similar object using a hinged attachment. It is contemplated that any number of mechanisms can be used to rotate and lock the sled at various angles relative to the luggage or other object to which the sled device can be attached. While a specific mechanism is described below, which can be employed to control the movement of the sled device, this mechanism is provided as an example of a mechanism which may be used for this purpose. It is a part of the present disclosure that several other mechanisms can be used which can: (1) lock the sled device in a substantially upright "stored" position; (2) hold the sled device away, at a chosen angle, from the luggage or similar object in a "deployed" position, wherein the sled device remains locked in the deployed position while subjected to a horizontal force, such as that created by the downward force of luggage against one or more stairs; and (3) the ability to move the sled device back and forth between the stored and deployed positions. Furthermore, the ability to adjust the chosen angle should be part of this mechanism. Additionally, it is contemplated that the movement of the sled device can be controlled by the user's foot in some embodiments.

According to an embodiment, the sled can be extended by the use of a foot pedal, which can be connected to a movable gear mechanism attached to the sled through a connecting rod, all of which can be contained in the mechanism housing integrated inside of the luggage. The foot pedal can move along a cut-out track in the mechanism housing that can constrain the movement of the pedal, connecting rod, and movable gear mechanism to facilitate use.

According to an embodiment, the present extendable sled device can work as follows: the user can pivot the foot pedal away from the luggage such that it can stick straight out. Using a foot, the user can depress the foot pedal in the direction of the ground. The foot pedal, attached to the connecting rod constrained by a latch hook, rests atop a tine of a Y-component, whose base is connected to a locking spring connected to the mechanism housing. As the Y-component is depressed, the locking spring can contract and lock into position, effectively keeping the Y-component in a lower position. The other tine of the Y-component can be connected to a latch base, where the latch base can also be connected to a latching spring. With the Y-component in the lower position, the latching spring can exert a force against the latch base which is connected to the latch hook at a locking pivot point. The force exerted against the latch base can pivot and release the latch hook, thereby freeing the connecting rod (and foot pedal) to freely move along the cut-out track, which in turn allows the extendable sled its full range of motion.

To return the device to its locked position, the user can once again press the foot pedal towards the ground. This can allow the connecting rod to press against the rod tine of the Y-component, pushing the Y-component against the locking mechanism housing. This can release the locking spring, which can exert a force against the Y-component, lifting it back into its original position. The force of the latch base tine against the latch base can push the latching spring back into retracted position, and the latch base, acting on the latch pivot, can lower the latch hook over the connecting rod such that it is once again locked into position, preventing movement of the device.

The extendable sled, when released, can pivot on a sled pivot point until the sled encounters a set of stairs. As the sled hits the stairs, the force of the stairs pushing back against the sled can push the gear mechanism against the gear teeth located on the mechanism housing, which can lock the sled into a fixed angle. The pushing can occur because the sled pivot point can be oblong in shape, affording the gear mechanism a slight range of motion such that it can engage and disengage from the gear teeth on the mechanism housing. The sled's range of rotation can be constrained by a peg inserted into a hole located along the cut-out track in the mechanism housing, such that the foot pedal's motion can be arrested when it hits the peg.

The extendable sled can also contain one or more stopper mechanisms, designed to arrest the luggage on a set of stairs if the user accidentally releases the luggage while climbing the stairs. The stopper mechanisms can have a swinging tab that can be attached to the stopper body by a tab pivot. When not in use, the swinging tabs can be locked inside the stopper body through the use of a stopper plate, which can attach atop the stopper body over the swinging tab. When in the locked position, the stopper plate can cover a portion of the swinging tab such that it cannot swing. When rotated to the open position, the stopper plate can contain an opening of sufficient length to allow the swinging tab to swing freely along the tab pivot. To prevent over-rotation of the stopper plate, the stopper plate can have a plate insert that can contact and be arrested by a body insert located on the stopper body. The stopper mechanisms can be inset to the extendable sled such that the stopper plate is flush with the face of the extendable sled.

FIG. 1 is a perspective view of luggage 100 with an integrated extendable sled 101 device, shown in a stored position, according to an embodiment. The integrated extendable sled device can comprise an extendable sled 101, having a front side and back side and first end and second end, connected to an extension mechanism 102, which can comprise a foot pedal 104 that can move along a cut-out track 106 cut into a mechanism housing 105. The extendable sled 101 can be connected to the extension mechanism 102 through a port 107 cut into the luggage 100. The luggage 100 can be any general object.

The extendable sled 101 and mechanism housing 105 can be made from high-impact plastics, metal, wood, or other materials with light weight and high strength. The extendable sled 101 can contain one or more stopper mechanisms 103 that can be used to arrest the luggage 100 on a flight of stairs (not shown) if a user (not shown) releases the luggage 100 during transport up the flight of stairs. In an embodiment, the extendable sled 101 can be a C-curve shape.

Figure 2:
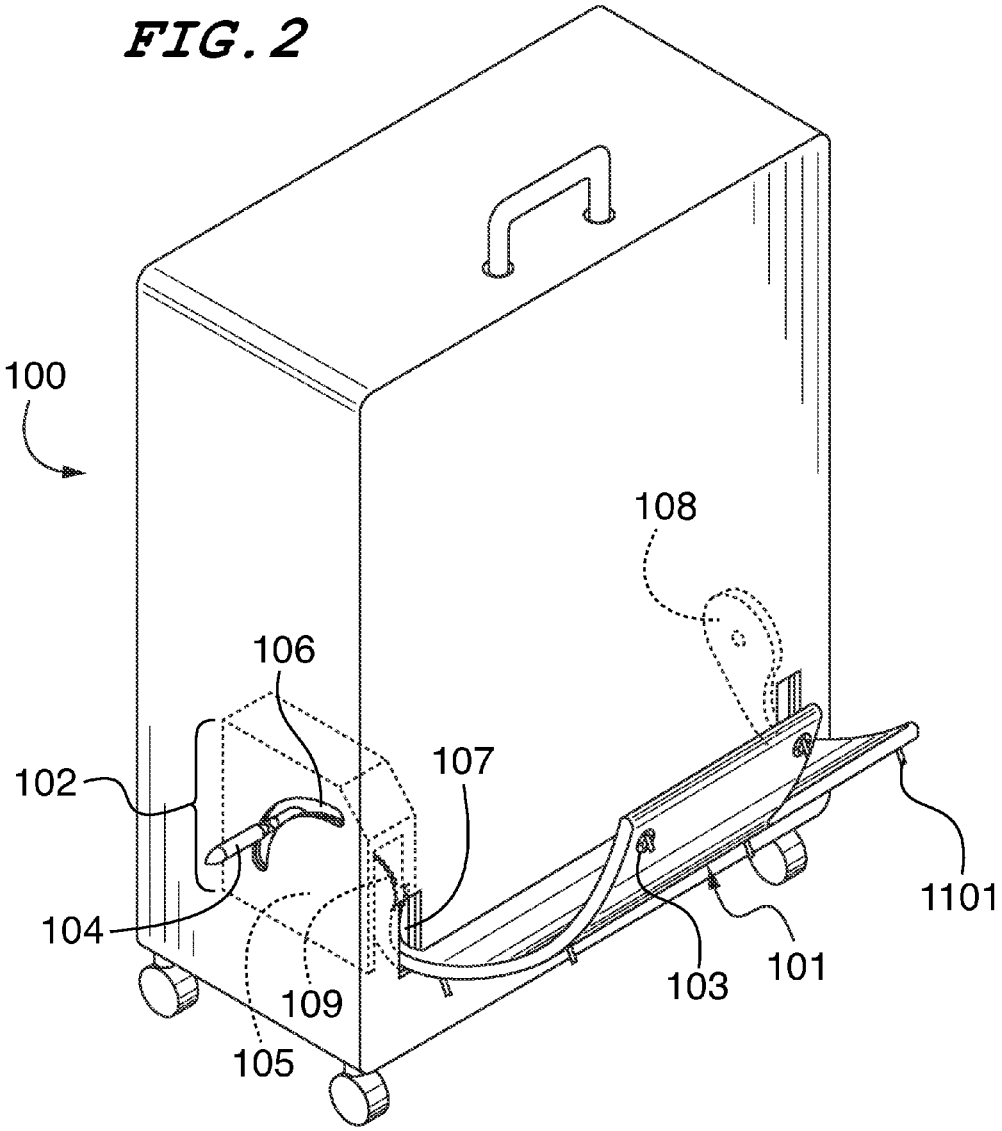
FIG. 2 is a perspective view of luggage with an integrated extendable sled device, shown in a deployed position, according to an embodiment.

FIG. 2 is a perspective view of luggage 100 with an integrated extendable sled device, shown in a deployed position, according to an embodiment. The user (not shown) can use a foot (not shown) to depress the foot pedal 104 and unlock the locking mechanism (not shown), allowing the foot pedal 104 its full range of motion within the cut-out track 106 in the mechanism housing 105. The foot pedal 104 can be connected to the gear mechanism 109 by a connecting rod (not shown), such that as the foot pedal 104 travels up the cut-out track 106, the gear mechanism 109, connected to the extendable sled 101, also moves along the same axis of rotation. The extendable sled 101, which can be anchored to the luggage 100 through connection to the gear mechanism 109 and the anchor pivot 108, can be extended or raised by the foot pedal 104. As the extendable sled 101 is lowered, tabs 1101 on the stopper mechanisms 103 can begin to hang down if the stopper mechanisms 103 are unlocked. The extendable sled 101 can be lowered to an angle between 30 degrees and 75 degrees away from the luggage.

Figure 3:
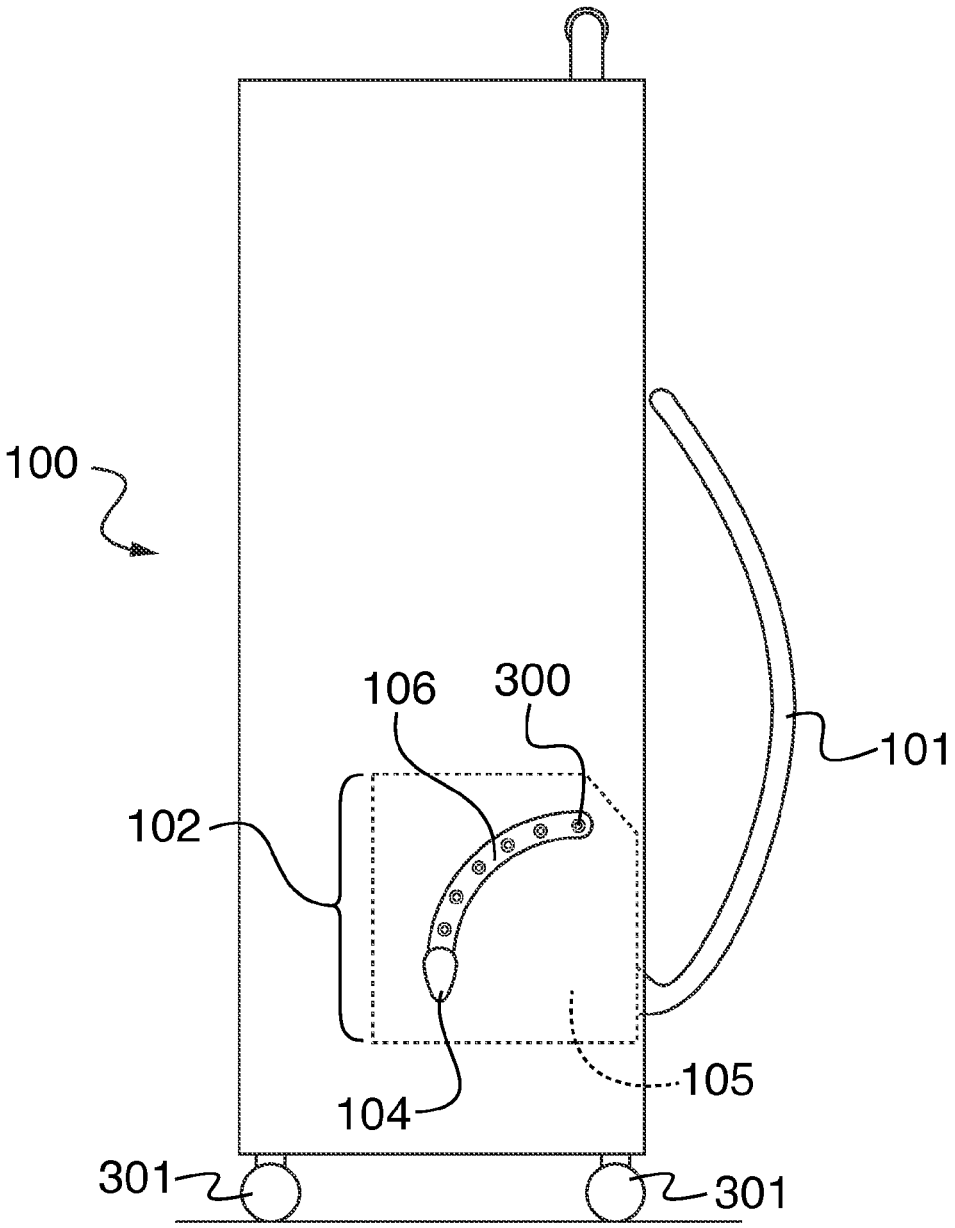
FIG. 3 is a side view of luggage with an integrated extendable sled device, shown in a stored position, according to an embodiment.

FIG. 3 is a side view of luggage 100 with an integrated extendable sled device, shown in a stored position, according to an embodiment. The extendable sled 101, along with the extension mechanism 102, can be positioned high enough on the luggage 100 such that the extendable sled 101, when extended, does not interfere with the wheels 301 of the luggage, giving the luggage enough clearance up a flight of stairs (not shown). This view shows holes 300, located in the mechanism housing 105, which can be drilled at discrete intervals along the cut-out track 106. These holes 300 can be of sufficient diameter to admit a peg (not shown), such that the range of motion of the foot pedal 104 (and thus the entire extendable sled 101 assembly) can be constrained as the foot pedal 104 is arrested by the peg (not shown).

Figure 4:
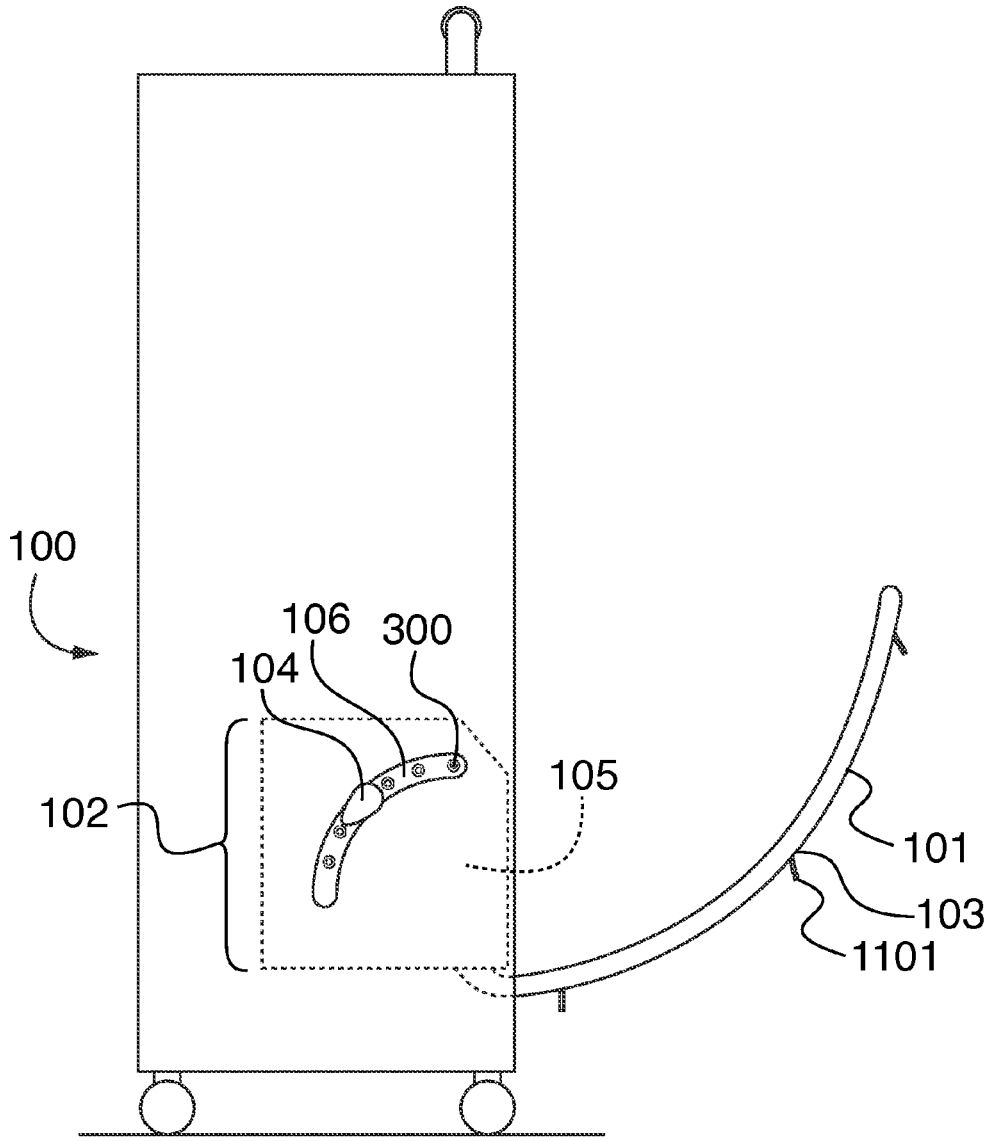
FIG. 4 is a side view of luggage with an integrated extendable sled device, shown in a deployed position, according to an embodiment.

FIG. 4 is a side view of luggage 100 with an integrated extendable sled device, shown in a deployed position, according to an embodiment. The user (not shown) can use a foot (not shown) to depress the foot pedal 104 and unlock the locking mechanism (not shown), allowing the foot pedal 104 its full range of motion within the cut-out track 106 in the mechanism housing 105. The foot pedal 104 can be connected to the gear mechanism (not shown) by a connecting rod (not shown), such that as the foot pedal 104 travels up the cut-out track 106, the gear mechanism, connected to the extendable sled 101, also moves along the same axis of rotation. The extendable sled 101, which can be anchored to the luggage 100 through connection to the gear mechanism 109 and the anchor pivot 108, can be extended or raised by the foot pedal 104. As the extendable sled 101 is lowered, tabs 1101 on the stopper mechanisms 103 can begin to hang down if the stopper mechanisms 103 are unlocked. Thus, a rising foot pedal 104 can result in a lowered extendable sled 101, and vice versa. The extendable sled 101 can be lowered to an angle between 30 degrees and 75 degrees away from the luggage.

Figure 5:
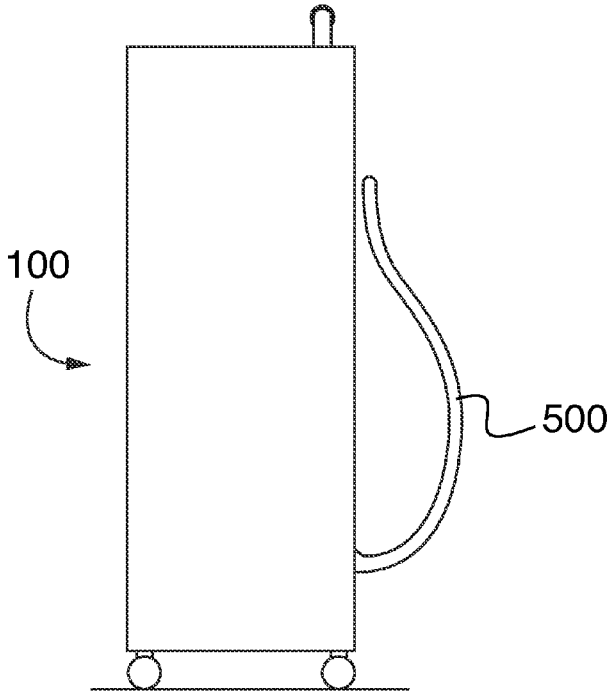
FIG. 5 is a side view of luggage with an integrated extendable sled device, in a stored position, according to an alternate embodiment.

FIG. 5 is a side view of luggage 100 with an integrated extendable sled device, in a stored position, according to an alternate embodiment. In an alternate embodiment, the extendable sled 500 can be shaped in an S-curve, such that the bottom of the extendable sled 500 contacts stairs (not shown) before the top of the extendable sled 500.

Figure 6:
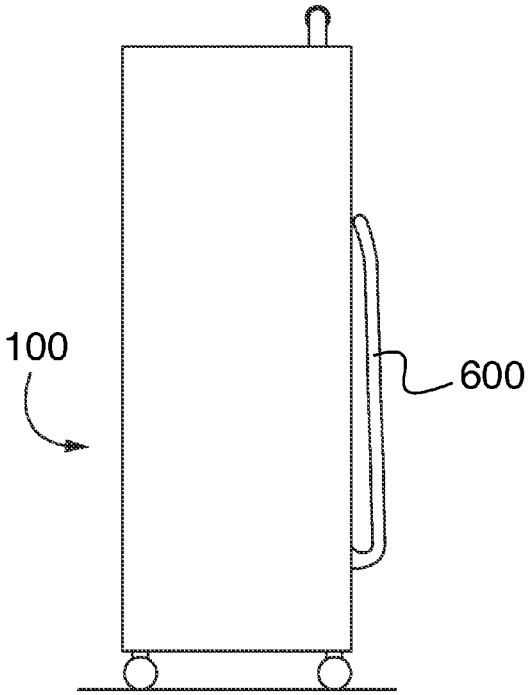
FIG. 6 is a side view of luggage with an integrated extendable sled device, in a stored position, according to a second alternate embodiment.

FIG. 6 is a side view of luggage 100 with an integrated extendable sled device, in a stored position, according to an alternate embodiment. In an alternate embodiment, the extendable sled 600 can be shaped in a J-curve, such that the extendable sled 600 touches stairs equally throughout its length.

Figure 7:
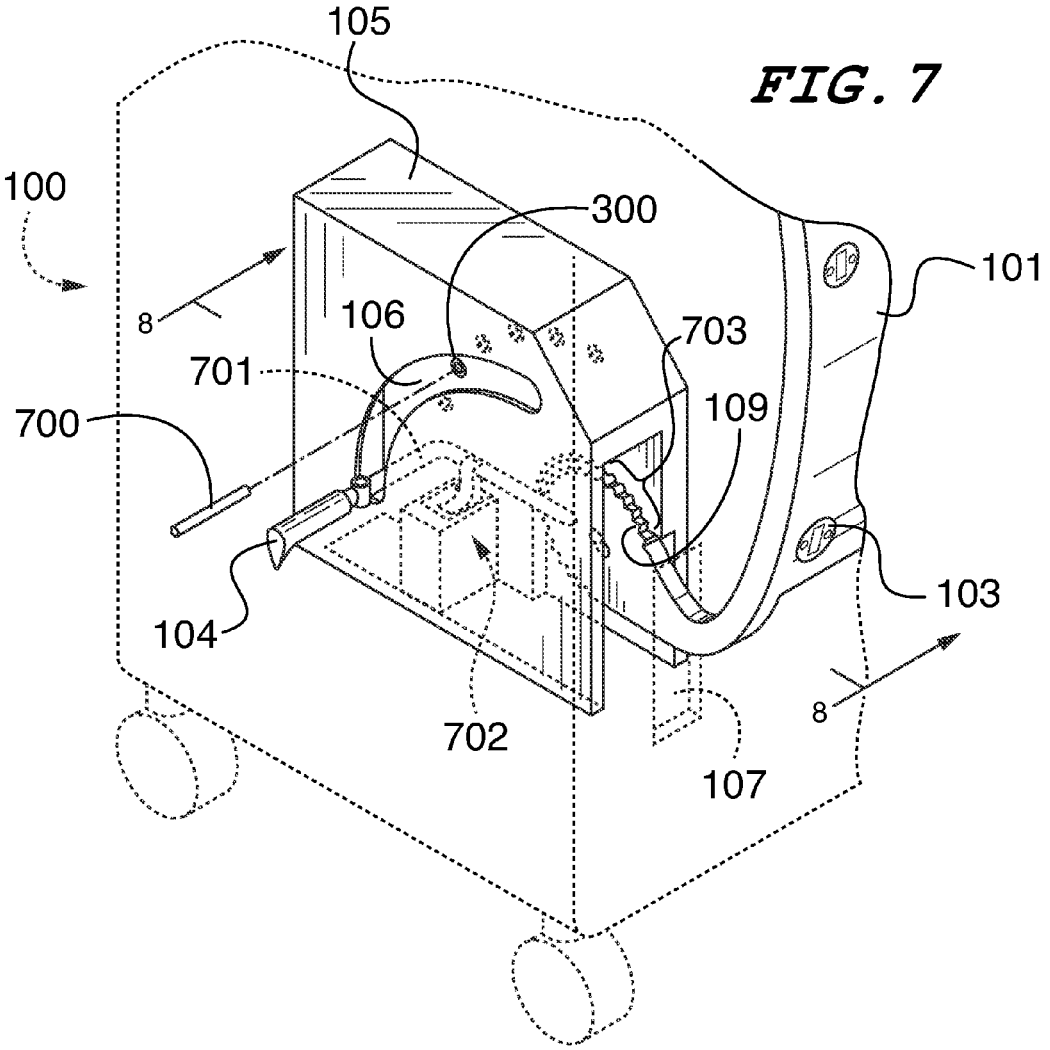
FIG. 7 is a perspective, partially transparent view of an extendable sled device extension mechanism, according to an embodiment.

FIG. 7 is a perspective, partially transparent view of an extendable sled device extension mechanism 102, according to an embodiment. The extension mechanism 102 can house the major components of the extendable sled device, which can include the connecting rod 701, locking mechanism 702, gear mechanism 109, and gear teeth 703. The foot pedal 104 can be connected to the gear mechanism 109 through the connecting rod 701, such that a movement of the foot pedal 104 can correspond to a movement of the gear mechanism 109. The gear mechanism can connect to the extendable sled 101 through a port 107 in the luggage. When not in use, the motion of the foot pedal 104 can be constrained by the locking mechanism 702, which can attach to the connecting rod 701 when engaged. When in use, the motion of the foot pedal 104 can be constrained by the addition of a peg 700 inserted into one of the holes 300 located along the cut-away track 106 in the mechanism housing 105.

Figure 8:
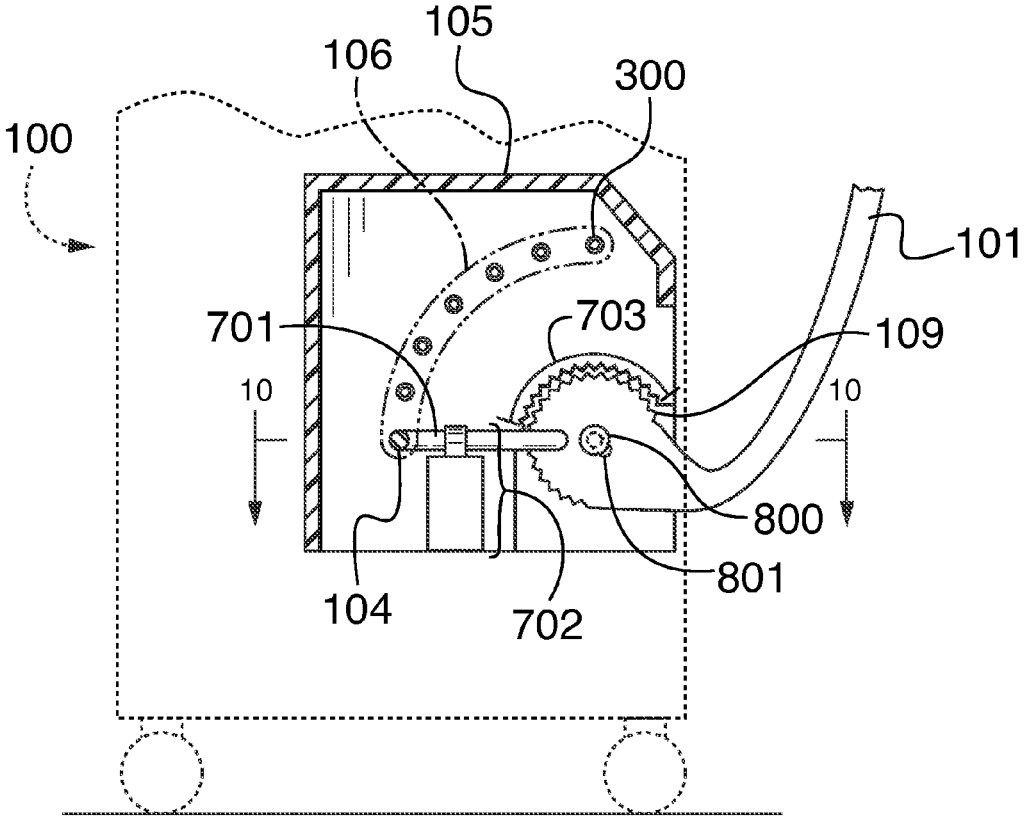
FIG. 8 is a side cut-away view of an extendable sled device extension mechanism, according to an embodiment.

FIG. 8 is a side cut-away view of an extendable sled device extension mechanism 102, according to an embodiment. In this view, the gear mechanism 109 can be shown to be aligned with the gear teeth 703, which are contained in the mechanism housing 105. The foot pedal 104 can be connected to the gear mechanism 109 through the connecting rod 701, which can be constrained by the locking mechanism 702. The gear mechanism 109 can be anchored to the mechanism housing 105 through a sled pivot point 800, which can be movable because the oblong hole 801 on the gear mechanism 109 can be a shape other than a perfect circle.

Figure 9:
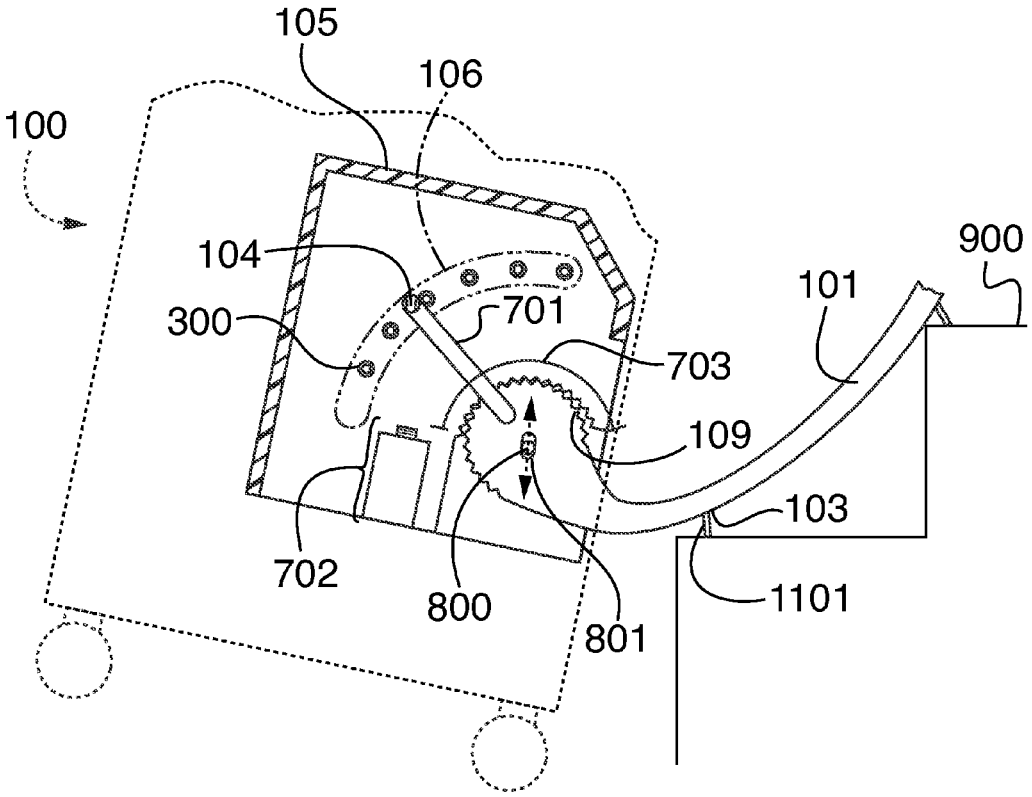
FIG. 9 is a side cut-away view of luggage with an integrated extendable sled device, in a deployed position and in use on stairs, according to an embodiment.

FIG. 9 is a side cut away view of luggage 100 with an integrated extendable sled device extended and in use on stairs 900, according to an embodiment. The extendable sled 101, once free to move after the locking mechanism 702 has been disengaged, can pivot on the sled pivot point 800 until the sled 101 encounters a set of stairs 900. As the sled 101 hits the stairs 900, the force of the stairs 900 pushing back against the sled 101 can push the gear mechanism 109 against the gear teeth 703 located on the mechanism housing 105, which can lock the sled 101 into a fixed position. The pushing can occur because the sled pivot point 800 can be mounted within the oblong hole 801, affording the gear mechanism 109 a slight range of motion such that it can engage and disengage from the gear teeth 703 on the mechanism housing 105. The sled's 101 range of rotation can be constrained by a peg (not shown) inserted into a hole 300 located along the cut-out track 106 in the mechanism housing 105, such that the foot pedal's 104 motion can be arrested when it hits the peg (not shown).

The extendable sled can also contain one or more stopper mechanisms 103, designed to arrest the luggage 100 on a set of stairs 900 if the user (not shown) accidentally releases the luggage 100 while climbing the stairs 900. The tabs 1101, extending downwards from the stopper mechanisms 103, can be designed to only hinge in a single direction, and can be limited to hinge only to a predetermined angle. Once at that angle, the tabs 1101 will cease to hinge. If the tabs 1101 are contacting the stairs 900, and are completely hinged, the static friction created by the combined force of the tabs 1101 upon the stairs 900 can be sufficient to hold the luggage 100 in place, and prevent the luggage 100 from sliding back down the stairs 900 if a user loses control. However, as the user exerts an upwardly diagonal force on the luggage 100 as it is being slid up the stairs 900, the tabs 1101 can hinge freely, allowing the user to continue their upward journey.

Figure 10:
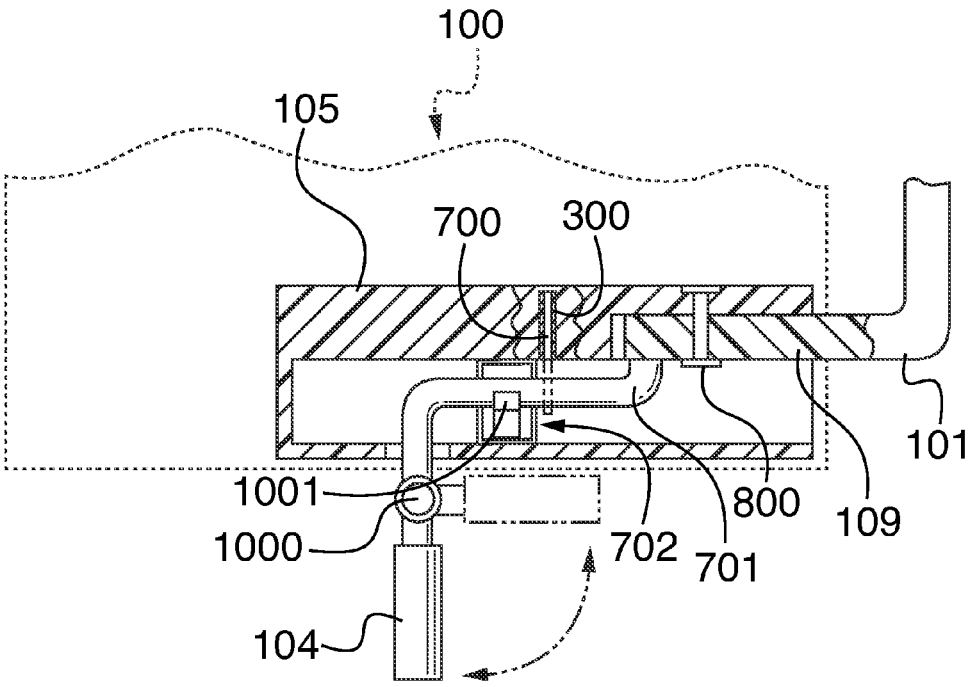
FIG. 10 is a top down cut-away view of an extendable sled device extension mechanism, according to an embodiment.

FIG. 10 is a top down cut-away view of an extendable sled device extension mechanism 102, according to an embodiment. The foot pedal 104 can be attached to the connecting rod 701 at a pedal pivot 1000, which can be used to pivot the foot pedal 104 out of the user's (not shown) way when the device is not being used. The connecting rod 701 can be locked in position by a latch hook 1001 that can be contained in the locking mechanism 702. The latch hook 1001 can be disengaged by depressing and releasing the foot pedal 104. In this view, the peg 700, which can be used to limit the foot pedal's 104 range of motion, can be seen inserted into the hole 300 located in the mechanism housing 105. Likewise, the gear mechanism 109 can be shown mounted to the mechanism housing 105 through the use of the sled pivot point 800. The gear mechanism 109 can connect to the extendable sled 101 through the port (not shown) in the luggage.

FIG. 11 is a perspective, partially transparent view of a stopper mechanism 103 while locked, according to an embodiment. The extendable sled 101 can also contain one or more stopper mechanisms 103, designed to arrest the luggage (not shown) on a set of stairs (not shown) if the user (not shown) accidentally releases the luggage while climbing the stairs. The stopper mechanisms 103 can have a swinging tab 1101 that can be attached to the stopper body 1404 by a tab pivot 1102. When not in use, the swinging tabs 1101 can be locked inside the stopper body 1404 through the use of a stopper plate 1100, which can attach atop the stopper body 1404 over the swinging tab 1101. The stopper plate 1100 can have a plate opening 1103 of sufficient size to allow movement of the swinging tab 1101, as well as finger holes 1104 to allow for manual rotation of the stopper plate 1100. When in the locked position, the stopper plate 1100 can cover a portion of the swinging tab 1101 such that it cannot swing.

FIG. 12 is a perspective, partially transparent view of a stopper mechanism 103 while unlocked, according to an embodiment. The user (not shown) can insert fingers (not shown) into the finger holes 1104 in the stopper plate 1100, and can rotate the stopper plate 1100 to the open position. When rotated to the open position, the stopper plate 1100 can contain a plate opening 1103 of sufficient length to allow the swinging tab 1101 to swing freely along the tab pivot 1106. To prevent over-rotation of the stopper plate 1100 by the user, the stopper plate 1100 can have a plate insert 1105 that can contact and be arrested by a body insert 1106 located on the stopper body 1404.

Figure 13:
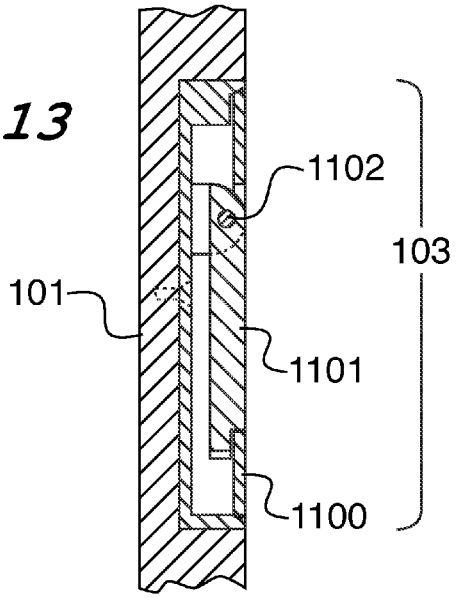
FIG. 13 is a side cut-away view of a stopper mechanism, according to an embodiment.

FIG. 13 is a side cut-away view of a stopper mechanism 103, according to an embodiment. The stopper mechanisms 103 can be inset to the extendable sled 101 such that the stopper plate 1100 and swinging tab 1101 are flush with the face of the extendable sled 101 when locked. While flush to with the extendable sled 101, the stopper mechanisms can not interfere with the interaction of the extendable sled 101 along the stairs (not shown), nor will they catch or snag on a user's (not shown) clothes or other bags.

Figure 14:
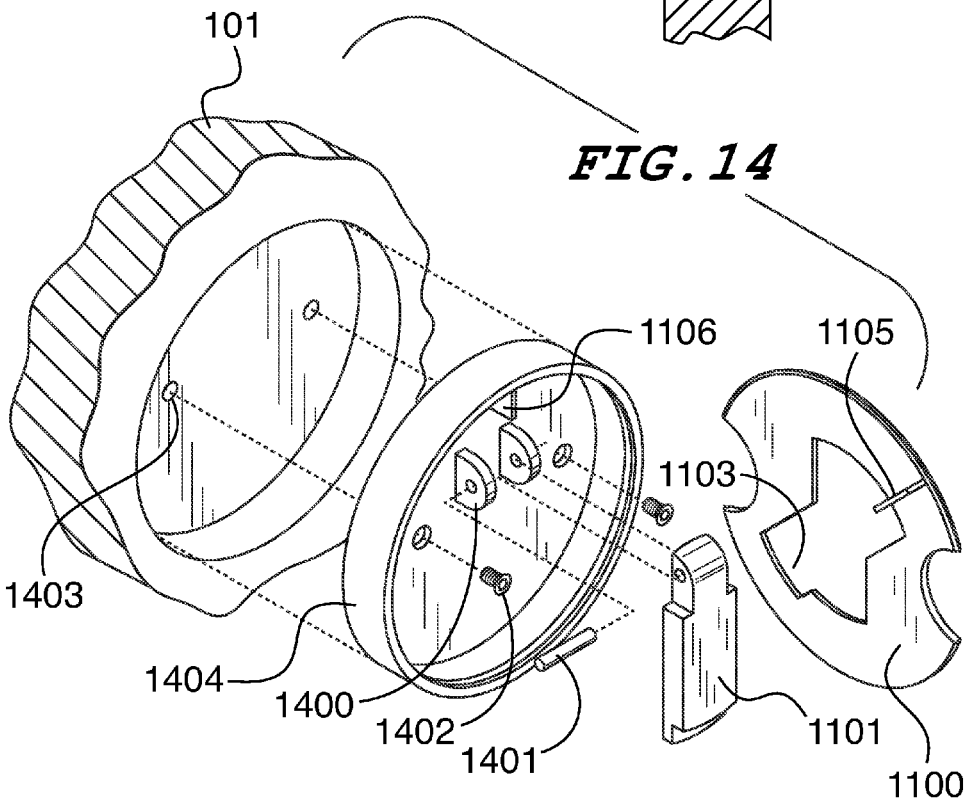
FIG. 14 is an exploded view of a stopper mechanism, according to an embodiment.

FIG. 14 is an exploded view of a stopper mechanism 103, according to an embodiment. The stopper body 1404 can be mounted to the extendable sled 101 through the use of one or more screws 1402, which can be inserted in one or more screw holes 1403. The swinging tab 1101 can be mounted to the stopper body 1404 through the use of a hinging bracket 1400 and a hinge pin 1401, allowing the swinging tab 1101 a limited amount of motion. The motion can be constrained by the stopper plate 1100, which can have an irregular-shaped plate opening 1103 of such a shape such that the swinging tab 1101 can swing free in the open position, but restrained in the closed position. To prevent over-rotation of the stopper plate 1100 by the user, the stopper plate 1100 can have a plate insert 1105 that can contact and be arrested by a body insert 1106 located on the stopper body 1404.

FIG. 15 is a cut-away view of a locked locking mechanism 702 for an integrated extendable sled device, according to an embodiment. The connecting rod 701 can be constrained by a latch hook 1001 which can rest atop a rod tine 1506 of a Y-component 1500, whose base 1508 can be connected to a locking spring 1503 connected to the locking mechanism housing 1504. The latch base tine 1507 of the Y-component 1500 can be connected to a latch base 1502, where the latch base 1502 can also be connected to a latching spring 1501. The latch base 1502 can be connected to the latch hook 1001 at a latch pivot 1505. In this view, the latch hook 1001 prevents the movement of the connecting rod 701.

FIG. 16 is a cut-away view of an unlocked locking mechanism 702 for an integrated extendable sled device, according to an embodiment. The present extendable sled device can work as follows: the user (not shown) can pivot the foot pedal (not shown) away from the luggage (not shown) such that it can extend perpendicular to the luggage. Using a foot (not shown), the user can depress the foot pedal towards the direction of the ground (not shown). As the Y-component 1500 is depressed, the locking spring 1503 can contract and lock into position, effectively keeping the Y-component 1500 in a lower position. With the Y-component 1500 in the lower position, the latching spring 1501 can exert a force against the latch base 1502 that can be connected to the latch hook 1001 at a latch pivot 1505. The force exerted against the latch base 1502 can pivot and release the latch hook 1001, thereby freeing the connecting rod 702 (and foot pedal (not shown)) to freely move along the cut-out track (not shown), which in turn allows the extendable sled (not shown) its full range of motion.

To return the device to its locked position, the user can once again press the foot pedal towards the ground. This can allow the connecting rod 701 to press against the rod tine 1506 of the Y-component 1500, pushing the base 1508 of the Y-component 1500 against the locking mechanism housing 1504. This can release the locking spring 1503, which can exert a force against the Y-component 1500, lifting it back into its original position. The force of the lifted latch base tine 1507 against the latch base 1502 can push the latching spring 1501 back into retracted position, and the latch base 1502, acting on the latch pivot 1505, can lower the latch hook 1001 over the connecting rod 701 such that it is once again locked into position, preventing movement of the entire device.

Although the present device has been described in terms of exemplary embodiments, it is not limited thereto. Rather, the appended claims should be construed broadly, to include other variants and embodiments of the present device, which may be made by those skilled in the art without departing from the scope and range of equivalents of the present device.

What is claimed is:

1. An extendable sled device, comprising: an extendable sled, having an elongated shape and having a first end and a second end and a front side and a back side, wherein the first end is pivotably connected by a hinged attachment to an object and configured to be moved radially between a stored position and a deployed position about this pivot created by the hinged attachment; an extension mechanism configured to lock the extendable sled in either the stored position or the deployed position and control movement of the extendable sled between the stored position and the deployed position and wherein the extension mechanism further comprises: a foot pedal; a connecting rod; a mechanism housing, having a cut-out track; a gear mechanism; and wherein the foot pedal is connected to the connecting rod, the connecting rod is connected to the gear mechanism, the gear mechanism is connected to the extendable sled, and the foot pedal is configured to extend the extendable sled by moving along the cut-out track in the mechanism housing: and the extension mechanism housing further comprises gear teeth wherein the gear mechanism and the gear teeth are configured to fit together.

2. The extendable sled device as recited in claim 1, wherein: the extendable sled is C-curved.

3. The extendable sled device as recited in claim 1, wherein: the extendable sled is S-curved.

4. The extendable sled device as recited in claim 1, wherein: the extendable sled is J-curved.

5. The extendable sled device as recited in claim 1, wherein: the extendable sled further comprises: one or more stopper mechanisms connected to the front side of the extendable sled, each comprising: a swinging tab; and a stopper body; wherein the swinging tab is attached to the stopper body by a tab pivot.

6. An extendable sled device, comprising:

an extendable sled, having an elongated shape and having a first end and a second end and a front side and a back side, wherein the first end is pivotably connected by a hinged attachment to an object and configured to be moved radially between a stored position and a deployed position about this pivot created by the hinged attachment;

an extension mechanism configured to lock the extendable sled in either the stored position or the deployed position and control movement of the extendable sled between the stored position and the deployed position and wherein the extension mechanism further comprises:

a foot pedal;

a connecting rod;

a mechanism housing, having a cut-out track;

a gear mechanism;

wherein the foot pedal is connected to the connecting rod, the connecting rod is connected to the gear mechanism, the gear mechanism is connected to the extendable sled, and the foot pedal is configured to extend the extendable sled by moving along the cut-out track in the mechanism housing and;

one or more stopper mechanisms connected to the front side of the extendable sled, each comprising:

a swinging tab;

a stopper body; wherein the swinging tab is attached to the stopper body by a tab pivot; and wherein the stopper mechanism further comprises a stopper plate, having a plate opening, and the stopper plate is attached to the stopper body such that the plate opening covers the swinging tab in a locked position and does not cover the swinging tab in an unlocked position.

7. A method of using an extendable sled device, comprising:

providing an extendable sled device comprising an extendable sled, having an elongated shape and having a first end and a second end and a front side and a back side, wherein the first end is pivotably connected to an object and configured to be moved radially between a stored position and a deployed position about this pivot, and; an extension mechanism configured to lock the extendable sled in either the stored position or the deployed position and control movement of the extendable sled between the stored position and the deployed position;

providing a set of stairs;

extending the extendable sled device to the deployed position;

transporting the object up the set of stairs, and;

retracting the extendable sled device to the stored position.

8. The method as recited in claim 7, wherein the extendable sled is J-curved.

9. The method as recited in claim 7, wherein the extendable sled is C-curved.

10. The method as recited in claim 7, wherein the extendable sled is S-curved.

11. A method of using an extendable sled device, comprising:

providing an extendable sled device comprising an extendable sled, having an elongated shape and having a first end and a second end and a front side and a back side, the extendable sled further comprising:

one or more stopper mechanisms connected to the front side of the extendable sled, each comprising:

a swinging tab;

a stopper body;

a stopper plate, having a plate opening;

wherein the swinging tab is attached to the stopper body by a tab pivot, and the stopper plate is attached to the stopper body such that the plate opening covers the swinging tab, and;

wherein the first end is pivotably connected to an object and configured to be moved radially between a stored position and a deployed position about this pivot, and; an extension mechanism configured to lock the extendable sled in either the stored position or the deployed position and control movement of the extendable sled between the stored position and the deployed position;

providing a set of stairs;

unlocking the one or more stopper mechanisms;

extending the extendable sled device to the deployed position;

transporting the object up the set of stairs;

retracting the extendable sled device to the stored position, and;

locking the one or more stopper mechanisms.

12. The method as recited in claim 11, wherein the extendable sled is J-curved.

13. The method as recited in claim 11, wherein the extendable sled is C-curved.

14. The method as recited in claim 11, wherein the extendable sled is S-curved.

* * * * *